US005915472A

United States Patent [19]

Takikawa et al.

[11] Patent Number: 5,915,472

[45] Date of Patent: Jun. 29, 1999

[54] APPARATUS FOR COOLING EGR GAS

[75] Inventors: Kazunori Takikawa, Numazu; Seiji Yamoto, Yugawara-machi; Yuji Miyauchi, Shizuoka Prefecture, all of Japan

[73] Assignee: Usui Kokusai Sangyo Kaisha Limited, Japan

[21] Appl. No.: 08/858,614

[22] Filed: May 20, 1997

[30] Foreign Application Priority Data

May 22, 1996 [JP] Japan ..... 8-150373

[51] Int. Cl.[6] ..... F28F 9/02

[52] U.S. Cl. ..... 165/158; 165/160; 165/162; 165/DIG. 416

[58] Field of Search ..... 165/159, 161, 165/160, 162, DIG. 416

[56] References Cited

U.S. PATENT DOCUMENTS

| | | | |
|---|---|---|---|
| 3,147,743 | 9/1964 | Romanos | 165/159 |
| 4,049,048 | 9/1977 | Leedham | 165/161 |
| 4,360,059 | 11/1982 | Funke | 165/162 |
| 4,749,031 | 6/1988 | Fukumoto | 165/162 |
| 4,834,173 | 5/1989 | Weiss et al. | 165/162 |
| 5,181,561 | 1/1993 | Ayers et al. | 165/162 |
| 5,255,737 | 10/1993 | Gentry et al. | 165/162 |

FOREIGN PATENT DOCUMENTS

| | | | |
|---|---|---|---|
| 2565-340 | 12/1985 | France | 165/162 |
| 877-310 | 11/1981 | Germany | 165/162 |
| 892-188 | 12/1981 | Germany | 165/162 |
| 3136-865 | 3/1983 | Germany | 165/162 |
| 4-151496 | 5/1992 | Japan | 165/162 |
| 2164869 | 4/1986 | United Kingdom | 165/162 |

*Primary Examiner*—Ira S. Lazarus
*Assistant Examiner*—Terrell McKinnon
*Attorney, Agent, or Firm*—Anthony J. Casella; Gerald E. Hespos; Ludomir A. Budzyn

[57] ABSTRACT

A lightweight apparatus designed to cool the EGR gas of an engine efficiently by replacing baffle plates with one or more support plates having a plurality of through holes, which is further made up of a barrel, end caps, a tube sheet, and a plurality of heat transmission tubes. An inlet and an outlet of the EGR gas are provided on the end caps covering both ends of the barrel and the sheet metal-made tube sheet attached to both ends of an inner wall of the barrel holds the properly arranged heat transmission tubes inserted into the through holes. Each metal sheet-made support plate affixed to a number of spots on the inner wall of the barrel has a diameter a little larger than the inside diameter of the barrel so that its edge is bent inward to fit inside the barrel tight but slidably in the form of tongue-like pieces. In a similar way, a peripheral edge of each through hole is curled up to create another set of tongue-like pieces to fit tight but slidably outside the heat transmission tubes. These pieces enable each support plate to be set at a specified position inside the barrel and their frictional resistance exerts sufficient pressure to secure the support plate steadfastly and durably to the inner wall of the barrel to withstand vibrating environments. Brazing to augment this frictional fixation is preferable. There is a separate circulating route for a cooling medium as well.

22 Claims, 8 Drawing Sheets

PRIOR ART

PRIOR ART

APPARATUS FOR COOLING EGR GAS

BACKGROUND OF THE INVENTION

1. Field of the Invention

This invention relates generally to apparatus for cooling gas and more particularly to apparatus f or cooling the EGR gas by means of engine coolant, car air conditioner refrigerant, and cooling air.

2. Description of the Prior Art

A method of collecting part of exhaust gas from an exhaust system coupled with a return thereof to an engine's air intake system for addition to a fuel-air mixture is known as the EGR (Exhaust Gas Recirculation). Inasmuch as the EGR is highly conducive to inhibiting generation of nitrogen oxides, reducing pump loss, diminishing heat discharge to the coolant concomitant to a temperature drop of the combustion gas, increasing the specific heat ratio due to changes in the volume and composition of operating gas, and improving the resultant cycle efficiency, this is considered to be an effective method of improving the thermal efficiency of engines.

However, it is also known that a rise in the temperature of the EGR gas may cause degradation of the durability of the EGR valves and other related parts through the heat action thereof to produce breakage at an early stage. To remedy such situation, devices for cooling the EGR gas by means of engine coolant or cooling air have been proposed, and multi-tube heat exchangers are currently commercially available.

An example of the multi-tube heat exchangers currently employed in this instance is shown in FIG. 7. Namely, on one of the left and right ends or both ends of a heat exchanger body, there is provided a cap having an inlet of gas or an outlet thereof, which is partitioned via a divider wall. A barrel is fixedly connected to head members (hubs) containing a separate inlet of a cooling medium, and inside the barrel are a multiplicity of heat transmission tubes fixedly placed in proper order at connecting holes which are provided on the divider wall on both ends mentioned above. A nipple screwed to the inlet of the cooling medium and an outlet thereof is connected to a branch pipe such as a rubber hose, through which an engine coolant or cooling air is introduced or discharged, thereby cooling the EGR gas flowing inside the heat transmission tubes (see Japanese Utility Model Gazette No. 309/82).

Nevertheless, this prior art structure of the above-mentioned multi-tube heat exchangers has a problem of a large flow resistance created as flow of the engine coolant or cooling air is sharply curved at the inlet of the cooling medium. Further, cast or forged construction of the head members and the divider wall to which the multiplicity of heat transmission tubes are secured contributes to making weight of the heat exchanger body excessively heavy. Moreover, additional work is required to produce connecting holes to screw the branch pipes to the inlet of the cooling medium and the outlet thereof, while still more steps are necessary to fixedly arrange in proper order the multiplicity of heat transmission tubes on the divider wall. Hence, it takes a great number of assembly steps with a consequent deterioration of workability. Another adverse factor of the conventional structure stems from brazing which is performed to connect the multiplicity of heat transmission tubes to the divider wall: a difference in the wall thickness between the heat transmission tubes and the divider wall indicates a difference in heat capacity, a cause of poor reliability for maintaining strength of the brazed sections, leading to chances of causing faulty brazing.

The applicant of the present invention proposed a novel apparatus for resolution of the above-mentioned problems in Japanese Patent Laid-Open No.267691/95 (filed on Sep. 21, 1995). As shown in FIG. 8, this is a multi-tube apparatus for cooling the EGR gas having a tube sheet secured to the inner wall of both ends of the barrel on which a plurality of heat transmission tubes are fixedly set up in proper order, and at the caps on the ends of the above-mentioned barrel there are provided an inlet of EGR gas and an outlet thereof. Furthermore, construction of the apparatus includes an inlet of the cooling medium and an outlet thereof on the barrel proper by means of burring towards the outside, while a plurality of branch pipes are joined to the inlet of the cooling medium and the outlet thereof through direct brazing or welding.

The EGR gas cooling apparatus proposed in Japanese Patent Laid-Open No. 267691/95 was effective in ameliorating the above-mentioned difficulties. This fact notwithstanding, since the EGR gas cooling apparatus was subject to vibrating environments due to engine, vibration generating during running as well as pulsation concomitant to pressure fluctuation of the EGR gas proper, stress tended to converge upon the joints between the heat transmission tubes and the tube sheet. It was also necessary to pay more consideration to the strength of the heat transmission tubes proper with respect to the above-mentioned vibration.

Many existing multi-tube heat exchangers designed for heat exchange between liquids are of a construction that disposes baffle plates at a plurality of locations in a longitudinal direction of the inner wall of the barrel, the baffle plates having through holes into which heat transmission tubes are inserted. In this case, flow of the cooling medium running outside the heat transmission tubes is made to take a detour via the baffle plates to enhance the heat exchange efficiency with the medium running inside the heat transmission tubes, thus necessitating certain sealing requirements, if not rigorous, between the heat transmission tubes and the through holes through which the tubes extend.

Be that as it may, the EGR gas cooling apparatus is essentially a device for cooling the EGR gas flowing inside the heat transmission tubes by exchanging heat thereof with the coolant or cooling air running outside the heat transmission tubes. Unlike a normal heat exchange exchanging heat between one liquid with another, especially when a coolant is used, the heat transmission coefficient outside the tubes ($Kcal/m^2hr°C.$) becomes about 100 times that inside the tubes, that is, effects of the contact direction and contact time of a liquid in contact with the outer surface of the heat transmission tubes upon the cooling effect of gaseous matter circulating inside the heat transmission tubes are extremely low. Consequently, it was confirmed by experiments conducted by the inventor of this invention that it was hardly necessary to set up the baffle plates for making flow of the external fluid to take a detour so as to move the fluid in a direction perpendicular to the axes of the heat transmission tubes and to take into consideration the seal property between the heat transmission tubes and the through holes of the baffle plates.

When the baffle plates were placed in the EGR gas cooling apparatus in the same way as the conventional multi-tube heat exchangers for purposes of heat exchange between liquids, there was a possibility that construction of the apparatus with the plain through holes provided by drilling the baffle plates as shown in FIG. 10 or with the through holes formed by burring into which the heat transmission tubes were inserted as shown in FIG. 11, in the event of being subjected to the above-mentioned vibrating environments, might suffer more than necessary shock, thus leading to deterioration of the service life of the heat transmission tubes.

SUMMARY OF THE INVENTION

In view of the foregoing, a primary object of the present invention is to provide an EGR gas cooling apparatus which can assure durability, especially in terms of sufficient vibration-resistant dynamic property. Another object of the present invention is to provide an EGR gas cooling apparatus having a simplified structure, which is as light as possible in weight and inexpensive to manufacture. A further object of the present invention is to provide an EGR gas cooling apparatus which offers approximately the same level of heat exchange properties as those of conventional heat exchangers by improving the above-mentioned difficulties and replacing baffle plates with support plates.

To accomplish these object described above, in the first preferred embodiment of the present invention, there is provided an EGR gas cooling apparatus which includes a plurality of heat transmission tubes fixedly arranged in proper order on a tube sheet secured to the vicinity of both ends of the inner wall of a barrel, end caps being mounted on both ends of the above-mentioned barrel, an inlet of the EGR gas and an outlet thereof being set up at the end caps. The EGR gas cooling apparatus is characterized in that the above-mentioned heat transmission tubes are supportingly inserted into through holes of at least one support plate having a plurality of tongue-like pieces at the periphery thereof which are formed in a curve at a diameter slightly larger than the inside diameter of the barrel and which make the support plate slidable on the inner wall of the above-mentioned barrel, slidable insertion of the support plate therein making it possible to set up the support plate at a predetermined position in the barrel to be fixed to the inner wall thereof through a frictional resistance between the above-mentioned tongue-like pieces and the inner wall thereof, preferably further by means of brazing.

In the second preferred embodiment, there is also provided an EGR gas cooling apparatus having a plurality of heat transmission tubes fixedly arranged in proper order at a tube sheet secured to the vicinity of both ends of the inner wall of a barrel, end caps being affixed to the outside of both ends of the above-mentioned barrel, an inlet of the EGR gas and an outlet thereof being set up thereon, and an inlet of a cooling medium and an outlet thereof being provided at the above-mentioned barrel. This EGR gas cooling apparatus is characterized in that the above-mentioned heat transmission tubes are supportingly inserted into the through holes of at least one support plate placed inside the barrel, while the support plate forming at the peripheral edge of the through holes tongue-like pieces which are curved at a diameter slightly smaller than the outside diameter of the above-mentioned heat transmission tubes to provide slidableness on the outer periphery side thereof, whereupon the support plate which is disposed at a predetermined position on the outer periphery side of the heat transmission tubes by slidably inserting the heat transmission tubes into the through holes is secured to the outer periphery side thereof due to a frictional resistance between the above-mentioned tongue-like pieces and the outer periphery side thereof, the securing preferably to be furthered by brazing.

Furthermore, the third preferred embodiment is based on an EGR gas cooling apparatus having a plurality of heat transmission tubes fixed to a tube sheet which is secured to the vicinity of both ends of the inner wall of a barrel, end caps being mounted on both ends of the above-mentioned barrel, an inlet of EGR gas and an outlet thereof being set up at the end caps, and an inlet of a cooling medium and an outlet thereof being provided at the above-mentioned barrel. This EGR gas cooling apparatus is so constructed that at least one support plate which holds up the heat transmission tubes by insertion thereof into the through holes of the support plate inside the above-mentioned barrel forms on the periphery thereof a plurality of first tongue-like pieces which are curved at a diameter slightly larger than the inside diameter of the barrel to gain slidableness on the inner wall of the above-mentioned barrel, and shapes on the edge of the periphery of the through holes thereof second tongue-like pieces which are curved at a diameter slightly smaller than the outside diameter of the above-mentioned heat transmission tubes to gain slidableness on the outer periphery side thereof, whereafter the above-mentioned support plate which is disposed at a predetermined position on the outer periphery side of the heat transmission tubes is fixed at a predetermined position inside the barrel through a frictional resistance between the above-mentioned first tongue-like pieces and the inner wall of the barrel as well as a frictional resistance between the above-mentioned second tongue-like pieces and the outer periphery of the heat transmission tubes, preferably with a fixing process to be furthered by means of brazing.

Moreover, the fourth preferred embodiment is a presentation of an EGR gas cooling apparatus, wherein a plurality of heat transmission tubes are fixedly arranged in a proper manner on a sheet metal-made tube sheet affixed to both ends of the inner wall of a barrel, the heat transmission tubes being supportingly inserted into the through holes of at least one support plate disposed at a predetermined position inside the above-mentioned barrel, end caps being mounted on both ends of the barrel, an inlet of the cooling medium and an outlet being provided at the barrel, and an inlet of the EGR gas and an outlet thereof being provided on the above-mentioned end caps. This EGR gas cooling apparatus also includes circulating means provided on the above-mentioned support plate for circulation of the cooling medium.

BRIEF DESCRIPTION OF THE DRAWINGS

The above and other objects of the invention will be seen by reference to the description taken in connection with the accompanying drawings, in which.

DETAILED DESCRIPTION OF PREFERRED EMBODIMENTS

The present invention purports to present an EGR gas cooling apparatus which is designed for the EGR gas to enter therein and perform heat exchange with a cooling medium such as engine coolant, which includes heat transmission tubes being supportingly inserted into through holes of a support plate disposed inside a barrel, preferably fixedly arranged in proper order or held up therein by pressure welding, which is installed in rigorous vibration environments, and which improves the cooling performance and durability of the apparatus by changing the shape of the support plate.

Figure 1:
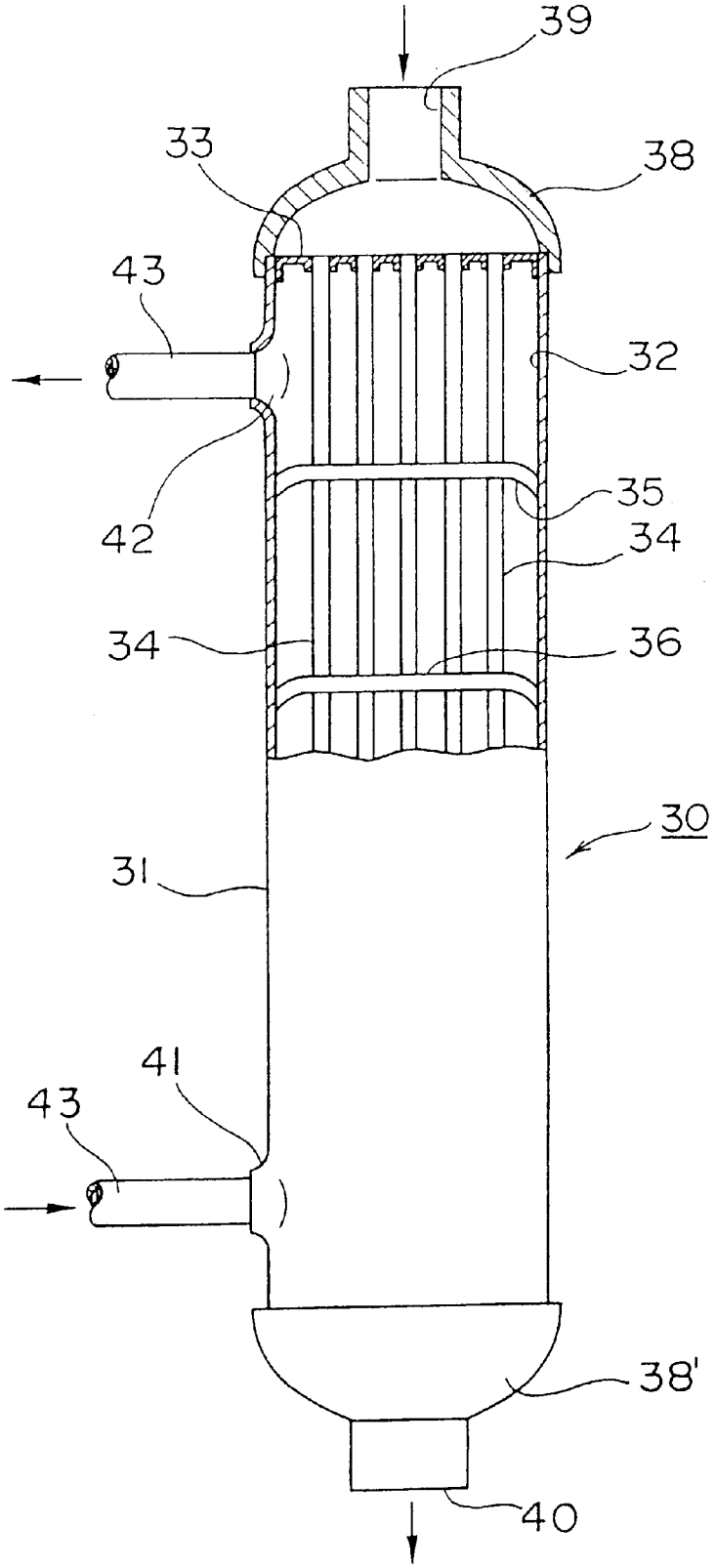
FIG. 1 is a partially cutaway plan view of an embodiment of the EGR gas cooling apparatus according to the present invention.
Figure 2A:
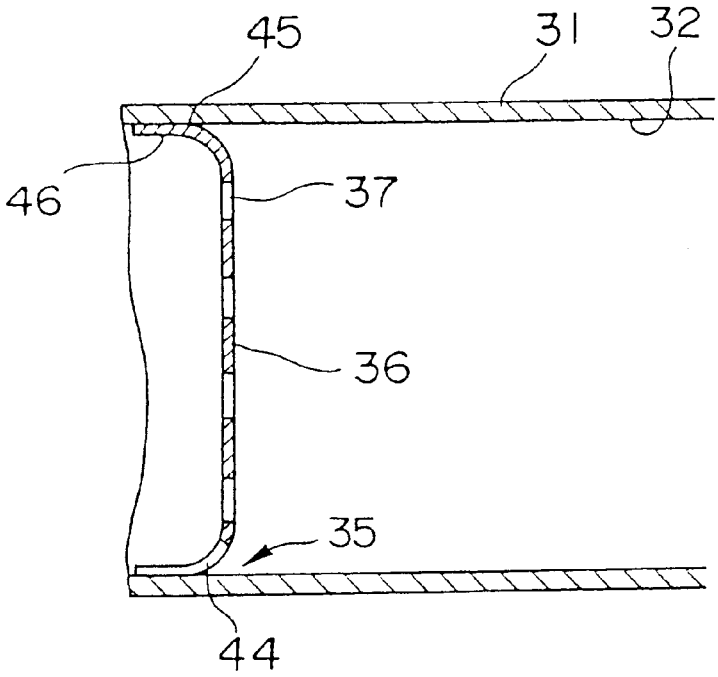
FIG. 2 shows an embodiment of the present invention, (a) showing a longitudinal sectional view and (b) showing a perspective view of a support plate.
Figure 2B:
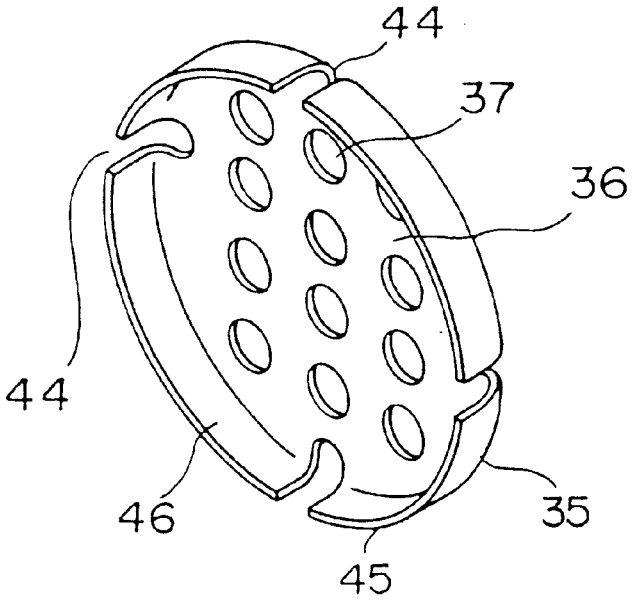
Figure 3:
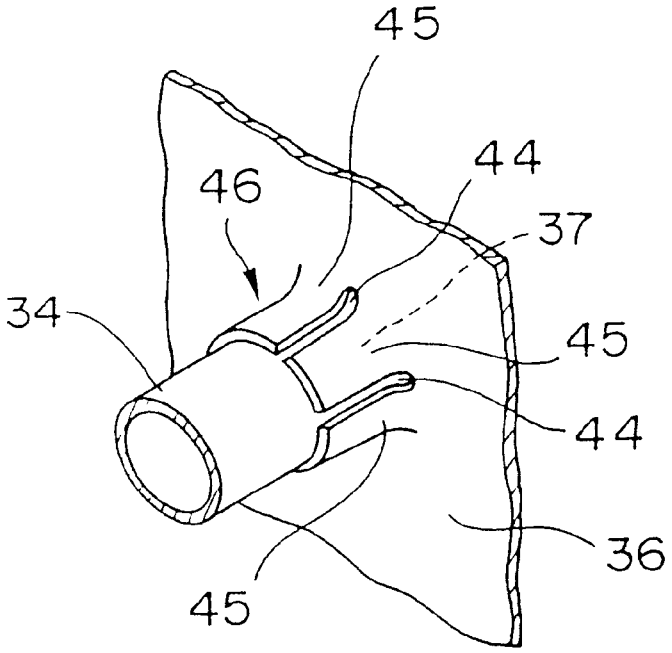
FIG. 3 is a sectional perspective view of a main part of another embodiment of the present invention.
Figure 4:
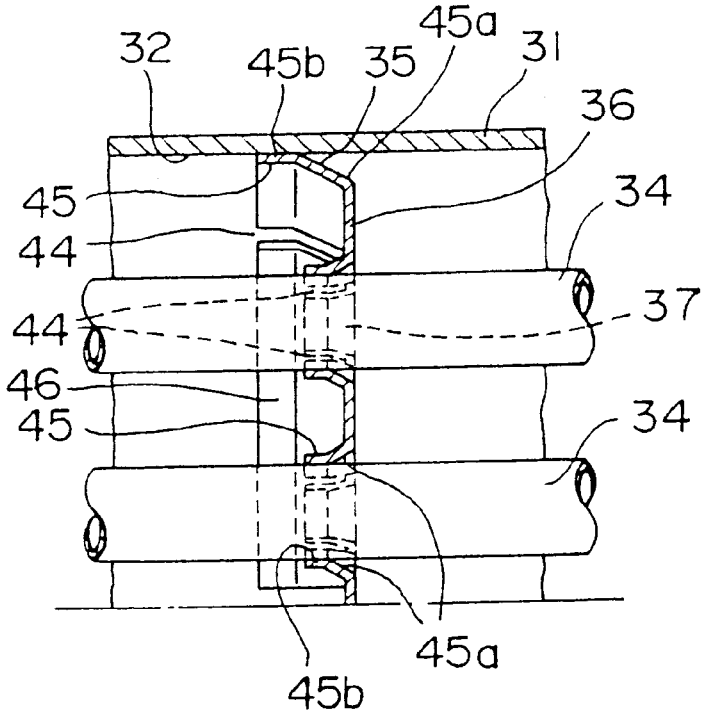
FIG. 4 is a longitudinal sectional view of a main part of an additional embodiment of the present invention.
Figure 5A:
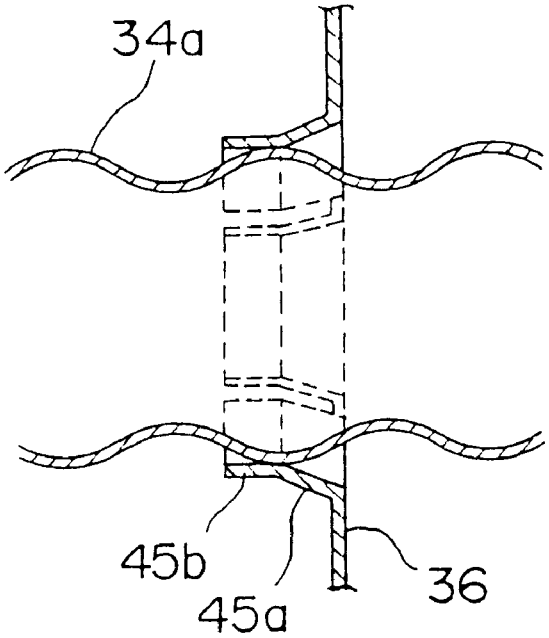
FIG. 5 shows a further embodiment of the present invention, (a) showing a longitudinal sectional view and (b) showing a partially expanded sectional view.
Figure 5B:
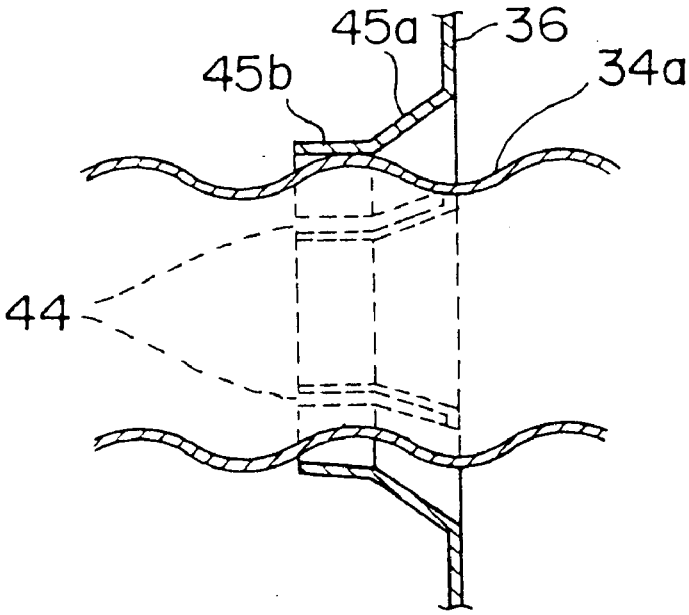
Figure 6A:
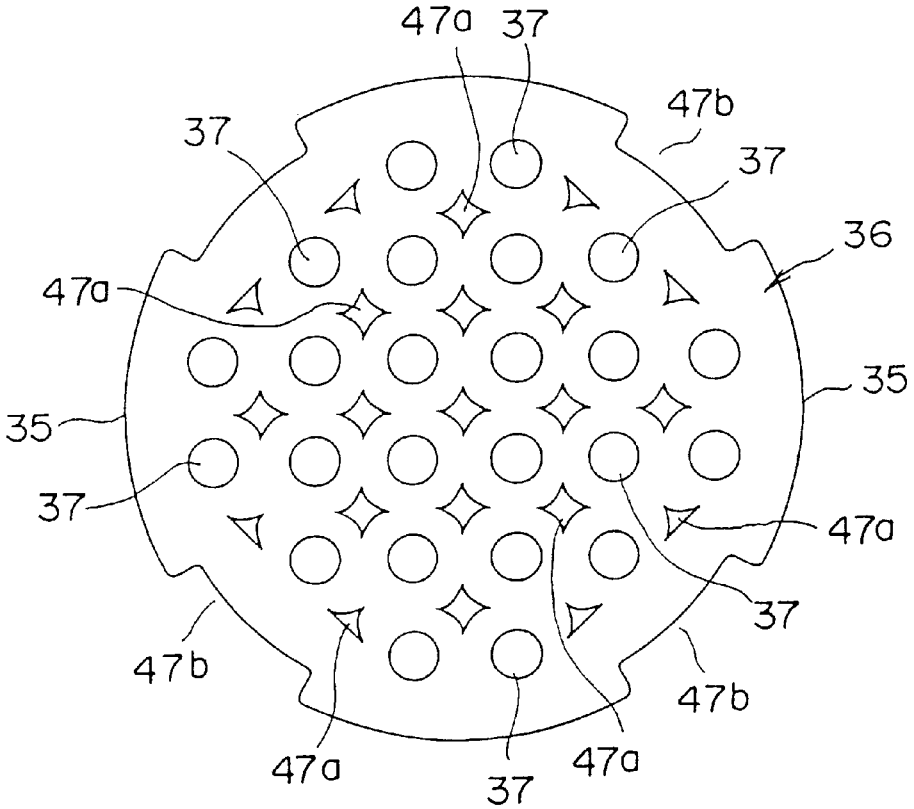
FIG. 6 is an even further embodiment of the present invention, (a) showing a front view of the embodiment and (b) showing a front view of another embodiment.
Figure 6B:
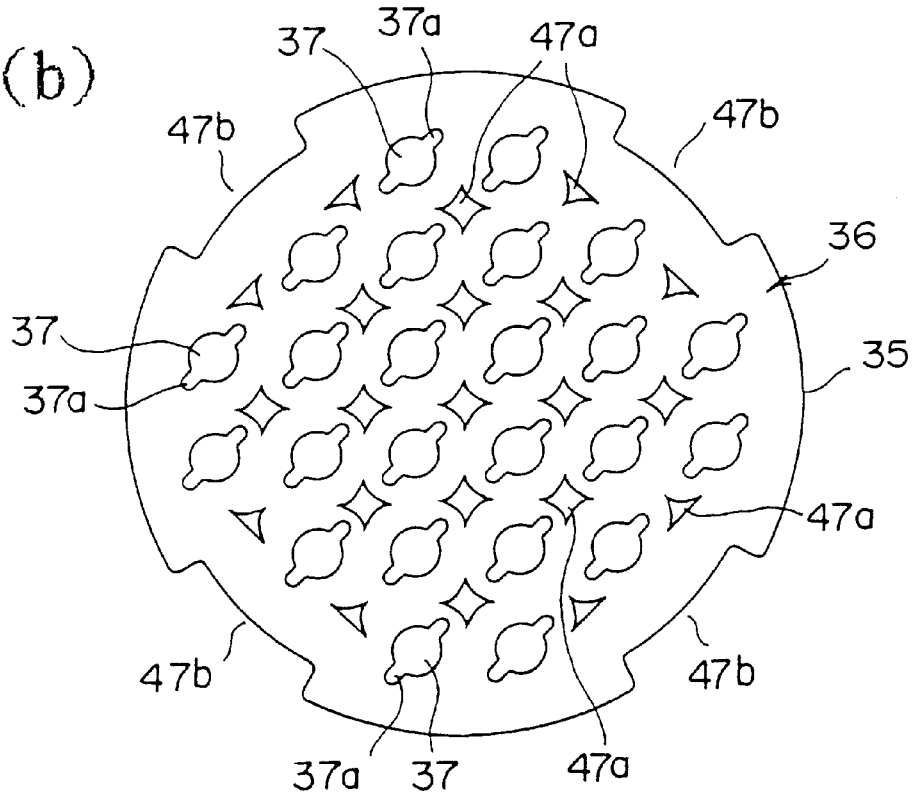
Figure 7:
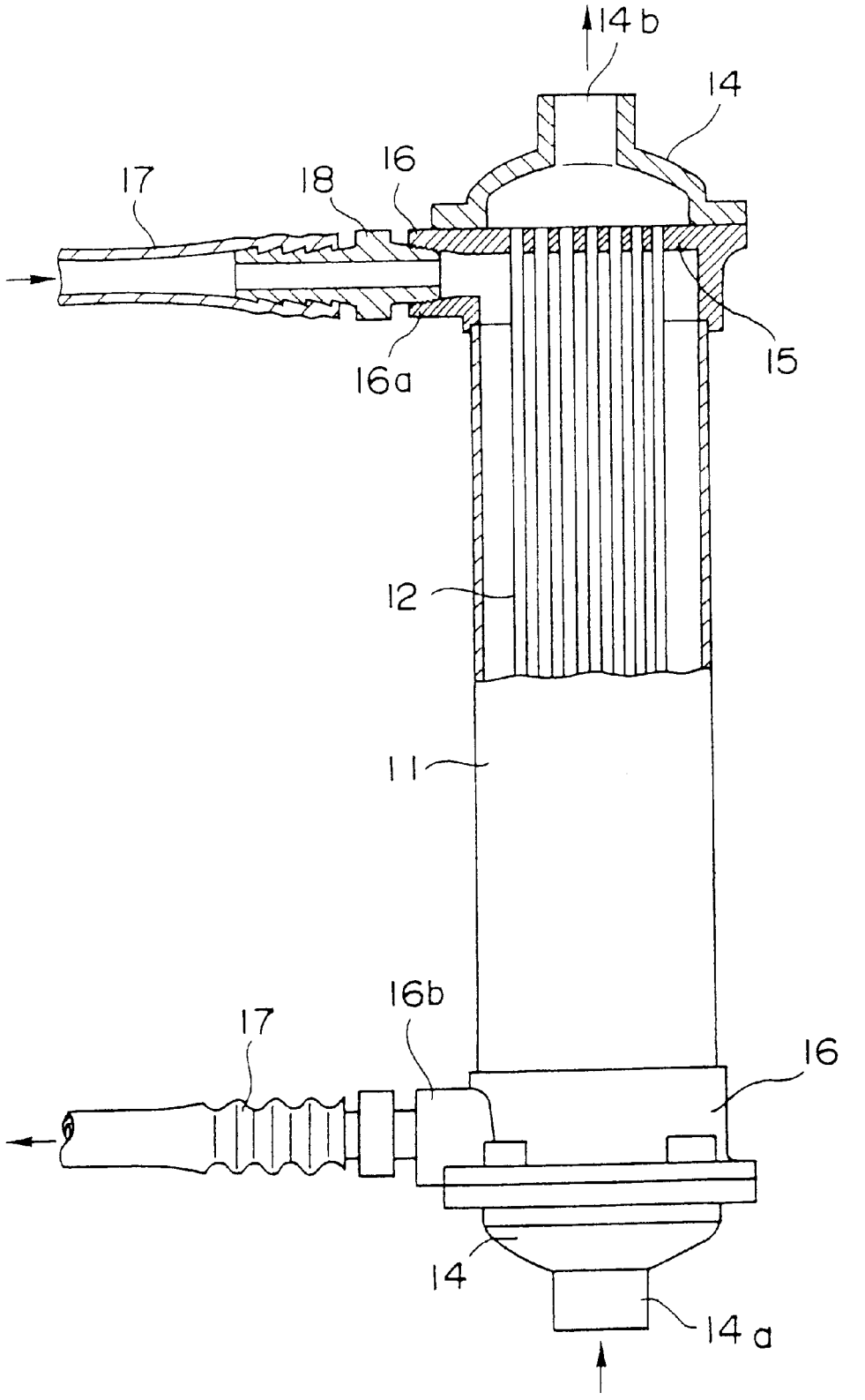
FIG. 7 is a partial cutaway plan view of a conventional apparatus.
Figure 8:
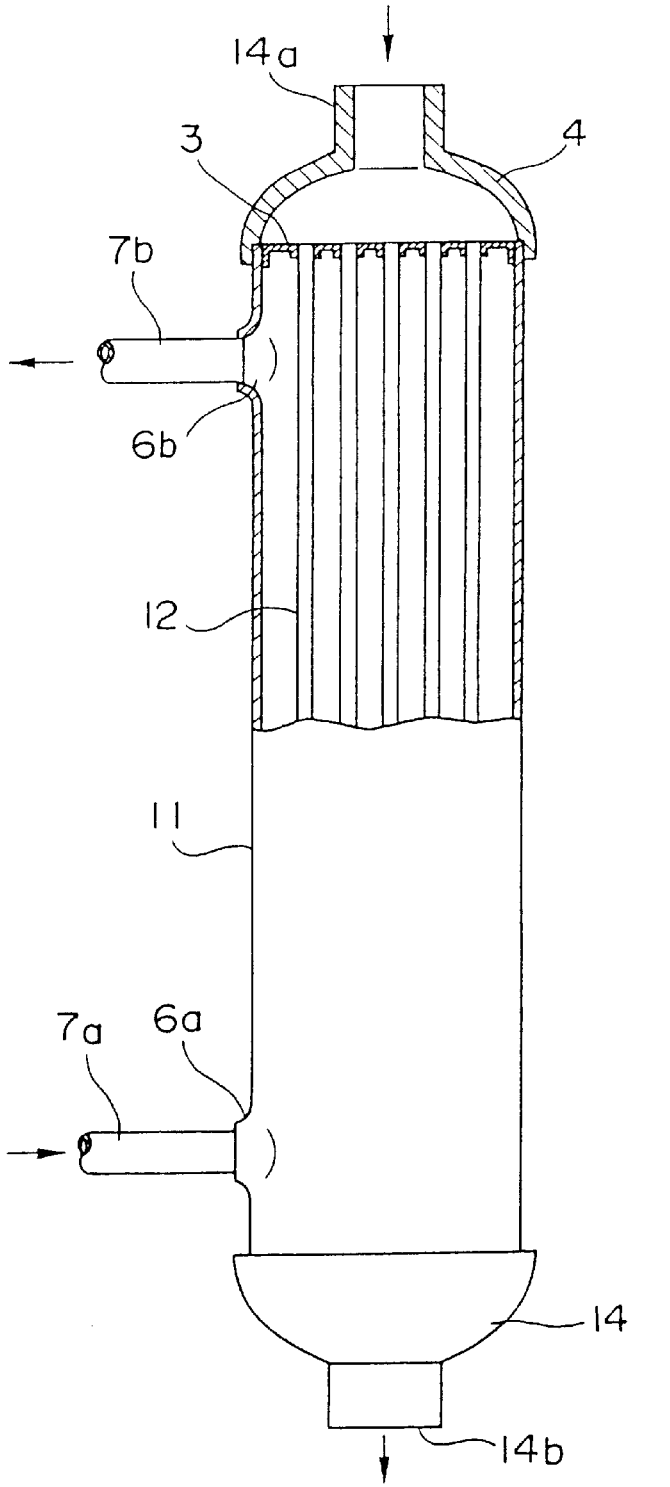
FIG. 8 is a partial cutaway plan view of another conventional apparatus.
Figure 9:
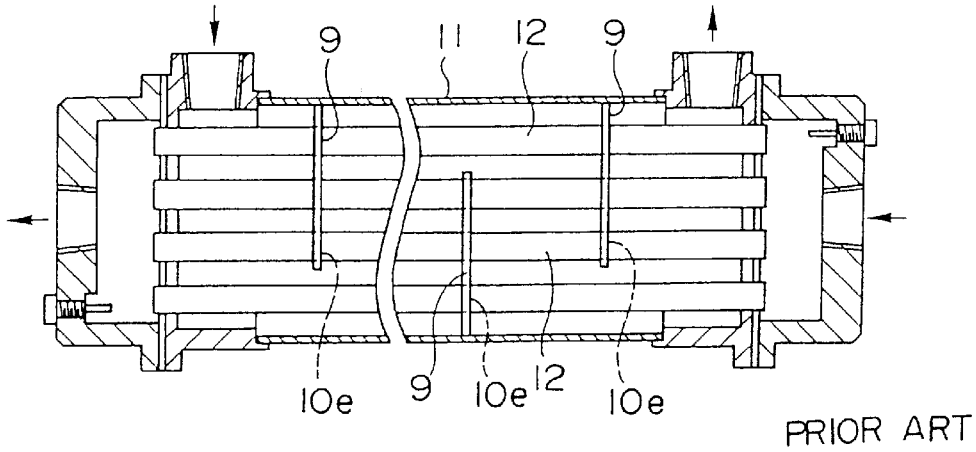
FIG. 9 is a sectional view of a main part of a multi-tube heat exchanger.
Figure 10:
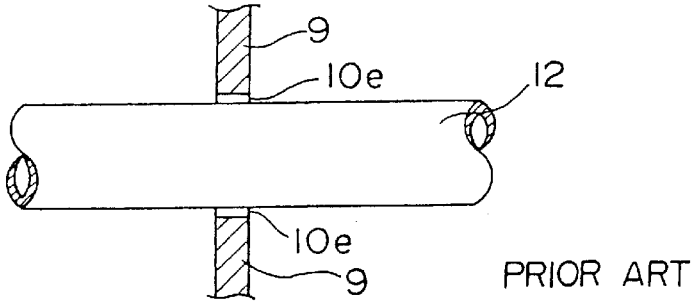
FIG. 10 is a sectional view of a main part of a conventional apparatus.
Figure 11:
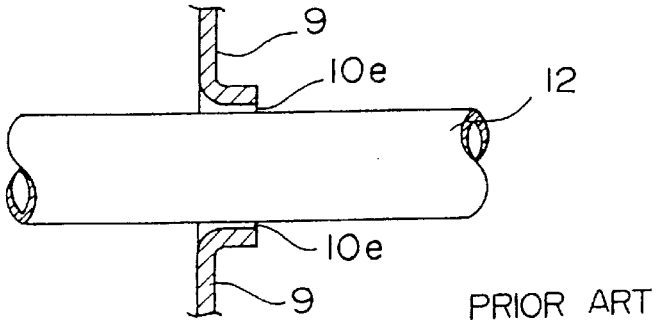
FIG. 11 is a sectional view of a main part of another conventional apparatus.

Description will be made of the present invention with reference to attached drawings. FIG. 1 is a partial cutaway plan view of an embodiment of the present invention. FIG. 2 shows an embodiment of the present invention, (a) being a longitudinal sectional view and (b) being a perspective view of a support plate. FIG. 3 is a sectional perspective view of a main part of another embodiment of the present invention, FIG. 4 is a longitudinal sectional view of a main part of an additional embodiment of the present invention, FIG. 5 is a further embodiment of the present invention, (a) showing a longitudinal sectional view and (b) showing a partially expanded sectional view, and FIG. 6 is an even further embodiment of the support plate according to the present invention, (a) showing a front view of the embodiment and (b) showing a front view of another embodiment. First referring to FIG. 1, there is provided a multi-tube EGR gas cooling apparatus 30 according to this invention comprising a sheet metal-made tube sheet 33 which is affixed to both ends of an inner wall 32 of a barrel 31 and which has a plurality of heat transmission tubes 34 fixedly arranged in proper order thereon, the heat transmission tubes 34 which are supportingly inserted into through holes of a support plate 36 an outer peripheral side 35 of which is secured to an inner wall 32 of the barrel 31 at a plurality of locations thereof, end caps 38 and 38' which are mounted on both ends of the above-mentioned barrel 31, an inlet of EGR gas 39 which is provided on the above-mentioned end cap 38, an outlet thereof 40 which is provided on the end cap 38', and an inlet of cooling medium 41 and an outlet of cooling medium 42 which are provided on the above-mentioned barrel 31 proper. Further, branch pipes 43 are connected to the above-mentioned inlet of cooling medium 41 and the outlet thereof 42.

The above-mentioned support plate 36 constitutes a baffle plate in conventional technology, whereas the support plate according to this invention functions to support the heat transmission tubes 34 to the barrel 31 and comprises a circular metal plate as shown in FIG. 2, an outer periphery 35 thereof having a wall 46 which is curved at a diameter slightly larger than the inside diameter of the barrel 31 and formed by burring, and curved tongue-like pieces 45 which are formed by axially providing a plurality of slits 44 to the curved wall.

Inasmuch as the tongue-like pieces are curved as mentioned above, each tongue-like piece 45 is slidable on the inner wall 32 of the barrel 31, wherefore slidable insertion thereof into the barrel 31 will enable the support plate 36 arranged at a predetermined position to be secured due to a frictional resistance between the tip of the above-mentioned tongue-like piece 45 and the inner wall 32 of the barrel 31, whereas preferably the contact part of the tip thereof and the inner wall 32 thereof are further subjected to brazing for securing the support plate thereto. Since the support plate 36 can be temporarily fixed to the predetermined position with respect to the barrel 31 due to the frictional resistance of the above-mentioned tongue-like pieces 45 and brazing work can be implemented as part of in-furnace brazing, the brazing as such can be accomplished with great ease.

It will be appreciated that a preferred method would be to compose brazing material as a plated layer applied to at least one surface of the support plate 36 because this would make it possible to conduct in-furnace brazing. It will also be appreciated that the brazing work can be accomplished by heating by hand brazing filler metal which may be set up at predetermined locations in powder or paste.

It will be noted that the EGR gas cooling apparatus 30 constructed in the foregoing manner has sufficient durability and elasticity effect even under vibrating environments as a result of the frictional resistance of the tongue-like pieces 45 provided at the outer periphery of the support plate 36, and that weight of the entire apparatus can be reduced inasmuch as the support plate 36 proper can be obtained by pressing sheet metal.

Referring to FIG. 3, there is shown another embodiment of the present invention, wherein a through holes 37 of a slightly smaller diameter than the outside diameter of a heat transmission tube 34 is provided by drilling a support plate 36 for the heat transmission tube 34 to be inserted thereto, a peripheral edge of a through hole 37 being formed into a curved wall 46 by means of burring, and curved tongue-like pieces 45 being formed by axially providing slits 44 on the curved wall 46.

The above-mentioned tongue-like pieces 45, being curved, are slidable relative to the heat transmission tube 34, so that upon slidable insertion of the heat transmission tube 34 into the through hole, the support plate 36 is placed at a predetermined position of the heat transmission tube 34 and the above-mentioned tongue-like pieces 45 are affixed to the heat transmission tube 34 through a frictional resistance or preferably secured thereto by means of brazing. Also, in this case, because the support plate 36 can be temporarily fixed at the predetermined position of the heat transmission tube 34 due to friction caused by the frictional resistance of the tongue-like pieces 45, brazing work such as in-furnace brazing can be executed very easily.

It will be understood that in this case, too, the heat transmission tube 34 can be supported by the frictional resistance of the tongue-like pieces 45 provided on the through holes 37 of the support plate 36, so that sufficient durability and elastic effect are obtained under vibrating environments with an added advantage of reduction of the weight of the apparatus as a whole due to availability of the support plate 36 proper through sheet metal working.

Moreover, as shown by FIG. 4, when the wall 46 curving towards the outer periphery of the above-mentioned support plate 36 and towards the peripheral edge of the through holes 37 is formed by burring and slits 44 are axially set up on the curved wall 46, the support plate 36 with the formation of curved tongue-like pieces 45 can be fixed at a predetermined position of the heat transmission tubes 34 inside the barrel 31 due to a frictional resistance, preferably further secured by brazing. The brazing, when performed, will contribute to enhancing the vibration control effect of the EGR gas cooling apparatus 30 under vibrating environments, resulting in improving durability and elasticity effect of the EGR gas cooling apparatus even more.

When the tongue-like pieces 45 are formed of two tapered portions 45*a* and 45*b* as shown in FIG. 4, upon abutment of the outside tapered portion 45*b* with an inner wall 32 of the barrel and an outer periphery side of the heat transmission tubes 34, the curve is slightly straightened out to be parallel to the above-mentioned inner wall 32 and the outer periphery side of the heat transmission tubes 34, thereby providing a brazing area and contributing to increasing brazing strength.

When the tongue-like pieces 45 are so formed as to include two tapered portions in this manner, in the event that each heat transmission tube is made up of a corrugate tube 34*a* as shown in FIG. 5, the outside tapered portion 45*b* makes a facial contact with the top or valley part of the wave surface, hence eliminating any faulty brazing. In this case, although there may be created a partial space with the outer periphery side of the corrugate tube 34*a,* this will pose no problem in terms of heat exchange efficiency and vibration control effect.

Referring next to FIG. 6, a still further embodiment of this invention will be explained. As clear from FIG. 6 (*a*), this embodiment contains circulating means including a plurality of through perforations 47*a* for permitting a cooling medium such as coolant or cooling air to circulate, which are dotted in a space among the through holes 37 for inserting the heat transmission tubes 34, slits 47*b* provided at the outer periphery 35 which are pressure welded to the inner wall 32 of the barrel 31, and further, as shown in FIG. 6(*b*), another circulating means including the plurality of through perforations 47*a* dotted in a space among the through holes 37 for inserting the heat transmission tubes 34 as well as notches 37*a* connected to the through holes 37. The above-mentioned circulating means can be used singly or jointly as necessary.

In this case, as shown in FIGS. 1 to 5, it is preferable to set up the curved tongue-like pieces 45 at the outer periphery 35 of the support plate 36 and at the peripheral edge of the through holes 37 or to secure by brazing the outer periphery 35 of the support plate 36 discontinuously to the inner wall 32 of the barrel 31 or the through holes 37 of the support plate 36 to the outer periphery side of the heat transmission tubes 34.

According to the embodiment in FIG. 6 as constructed in the foregoing manner, the heat transmission tubes 34 conventionally supported in an unfixed state by baffle plates inside the barrel 31 are instead held up with stability by the support plate 36 which is pressure welded, preferably arranged in proper order and secured to the inner wall 32 of the barrel 31, therefore enhancing the durability of the EGR gas cooling apparatus as a whole to be used under vibrating environments and reducing an increase in the weight thereof as much as possible. Moreover, reduction of a flow resistance of the cooling medium which occur due to the support plate 36 makes it possible to create an EGR gas cooling apparatus which prevents even vibration due to pulsation of the above-mentioned cooling medium.

In the explanation provided above, there is introduced a multi-tube EGR gas cooling apparatus having the inlet 39 of the EGR gas provided on one end cap 38 and the outlet 40 thereof provided on the other end cap 38'. However, the construction according to the present invention is also applicable to the conventional multi-tube EGR gas cooling apparatus 30 which contains a plurality of heat transmission tubes curved substantially in the U shape with the provision of both the inlet 39 of the EGR gas and the outlet 40 thereof on one end cap 38.

It will be appreciated that the provision of slits 44 and notches 37*a* in the periphery of the through holes into which the heat transmission tubes 34 are supportingly inserted will accelerate flow of coolant due to the nozzle effect, remove and push bubbles generating due to the high-temperature EGR gas out of the outer periphery side of the heat transmission tubes 34, resulting in prevention of the bubbles from expanding and an increase of the heat exchange efficiency.

In the aforementioned embodiment, description is made of the support plate comprising a circular metal sheet. The present invention is also applicable to the support plate having notches on the outer periphery thereof, to the doughnut-shaped support plate having a hole in the center, and further to the case of inserting the heat transmission tubes into a support plate having a diameter smaller than that of the inner wall 32 of the barrel 31. It is also possible to use these parts in combination.

In accordance with the present invention as explained above, in lieu of the baffle plates used for the multi-tube heat exchangers, a novel support plate fixedly arranged in proper order and secured or pressure welded to inside the barrel is provided as a component element of the EGR gas cooling apparatus, which forms a curved wall on the outer periphery of the support plate or the peripheral edge of the through holes or on both the outer periphery thereof and the peripheral edge thereof, whereupon curved tongue-like pieces are formed by axially providing slits on the curved wall so that the support plate can be easily fixed by means of a frictional resistance of the tongue-like pieces and that the brazing work to be conducted as necessary can also be facilitated. Also provided are circulating means such as a plurality of through perforations for circulating the cooling medium in addition to the through holes for the heat transmission tubes to be supportingly inserted therein, slits and notches associated with the above-mentioned through holes to enhance the vibration control effect of the EGR gas cooling apparatus under vibrating environments, thereby improving durability and elasticity effect. At the same time, formation of the support plate by sheet metal working will simplify the structure of the EGR gas cooling apparatus resulting in reduction of the entire weight. It will be appreciated that the present invention is especially effective when corrugate tubes are used to form the wave surface on the outer periphery side of the heat transmission tubes.

Although there have been described above specific arrangements of an EG gas cooling apparatus in accordance with the invention for the purpose of illustrating the manners in which the invention may be used to advantage, it is to be understood that the invention is not limited thereto. Accordingly, any and all modifications, variations or equivalent arrangements which may occur to those skilled in the art should be considered to be within the scope of the invention.

What is claimed is:

1. An EGR gas cooling apparatus, comprising a barrel having opposed open ends and an inner surface extending between said ends, said inner surface defining an inside diameter, tube sheets affixed to the inner surface of the barrel in proximity to the ends, each said tube sheet having a plurality of apertures therethrough, a plurality of heat transmission tubes fixedly arranged in the apertures of the tube sheets and extending therebetween, each said heat transmission tube having an outer periphery defining an outside diameter, end caps being mounted on both said ends of the barrel, an inlet and an outlet for EGR gas being provided through said respective end caps, an inlet for a cooling medium and an outlet therefor extending into the barrel at locations between the respective tube sheets, said apparatus comprising:

at least one support plate having an outer periphery, a plurality of cooling passages for accommodating the cooling medium extending through the support plate, a plurality of through holes formed through said support plate, said through holes being dimensioned and disposed for receiving the respective heat transmission tubes, each said through hole having a peripheral edge, a plurality of tongue-like pieces selected from the group consisting of a plurality of first tongue-like pieces at the outer periphery of the support plate which are curved at a diameter slightly larger than the inside diameter of the barrel and a plurality of second tongue-like pieces at the peripheral edges of the through holes which are curved at a diameter slightly smaller than the outside diameter of the heat transmission tubes, said support plate being slidably inserted inside the barrel and being disposed at a predetermined position in said barrel as a result of the slidable insertion therein, said tongue-like pieces being deflected at intermediate locations thereon for engagement with selected ones of said barrel and said heat transmission tubes such that said support plate is secured in the predetermined position by frictional resistance between the tongue-like pieces and at least one of the barrel and the heat transmission tubes for elastically supporting said heat transmission tubes in response to vibrations of said apparatus.

2. The EGR cooling apparatus as defined in claim 1, wherein the support plate is disposed at the predetermined position in the barrel by frictional resistance between said second tongue-like pieces and the outer periphery of the heat transmission tubes.

3. The EGR cooling apparatus as defined in claim 1, wherein the first tongue-like pieces and the inner surface of the barrel are further secured by brazing.

4. The EGR cooling apparatus as defined in claim 2, wherein the second tongue-like pieces and the outer periphery of the heat transmission tubes are further secured by brazing.

5. The EGR gas cooling apparatus as defined in claim 1, wherein the tongue-like pieces are separated from one another by notches formed in the support plate, said notches being dimensioned to define at least selected ones of the cooling passages for the cooling medium.

6. The EGR gas cooling apparatus as defined in claim 1, wherein the heat transmission tubes are corrugated.

7. The EGR gas cooling apparatus as defined in claim 1, wherein the cooling passages comprise cooling passages extending from the through holes for receiving the heat transmission tubes therein.

8. An EGR gas cooling apparatus, comprising a barrel having opposed open ends and an inner surface extending between said ends, said inner surface defining an inside diameter, tube sheets affixed to the inner surface of the barrel in proximity to the ends, each said tube sheet having a plurality of apertures therethrough, a plurality of heat transmission tubes fixedly arranged in the apertures of the tube sheets and extending therebetween, each said heat transmission tube having an outer periphery defining an outside diameter, end caps being mounted on both said ends of the barrel, an inlet and an outlet for EGR gas being provided through said respective end caps an inlet for a cooling medium and an outlet therefor extending into the barrel at locations between the respective tube sheets, said apparatus comprising:

at least one support plate, a plurality of through holes in the support plate, the heat transmission tubes being supportingly inserted into the through holes of the support plates, the support plate having an outer periphery secured to the inner surface of the barrel at a plurality of locations therein;

said support plate having a plurality of cooling passages extending therethrough, said support plate further forming at the outer periphery thereof a plurality of tongue-like pieces which are curved at a diameter slightly larger than the inside diameter of the barrel, said tongue-like pieces being deflected at intermediate locations thereon such that said support plate is made slidable on the inner surface of the barrel and is placed at a predetermined position in said barrel as a result of slidable insertion therein, said support plate being secured to the inner surface of the barrel by a frictional resistance between the deflected tongue-like pieces and the inner surface of the barrel for elastically supporting said heat transmission tubes in response to vibrations of said apparatus.

9. The EGR gas cooling apparatus as defined in claim 8, wherein the tongue-like pieces and the inner wall of the barrel are fixed by brazing.

10. The EGR gas cooling apparatus as defined in claim 8, wherein the support plate includes notches formed between the respective tongue-like pieces, said notches extending inwardly from said inner surface of said barrel for defining a plurality of said cooling passages.

11. The EGR cooling apparatus as defined in claim 8, wherein the heat transmission tubes are corrugated.

12. The EGR cooling apparatus as defined in claim 8, wherein the through holes for supporting the heat transmission tubes therein include extensions defining a plurality of the cooling passages.

13. An EGR gas cooling apparatus, comprising a barrel having opposed open ends and an inner surface extending between said ends, tube sheets affixed to the inner surface of the barrel in proximity to the ends, each said tube sheet having a plurality of apertures therethrough, a plurality of heat transmission tubes fixedly arranged in the apertures of the tube sheets and extending therebetween, each said heat transmission tube having an outer periphery defining an outside diameter, end caps being mounted on both said ends of the barrel, an inlet and an outlet for EGR gas being provided through said respective end caps, an inlet for a cooling medium and an outlet therefor extending into the barrel at locations between the respective tube sheets, said apparatus comprising:

at least one support plate having an outer periphery dimensioned for slidably inserting said support plate into said barrel, a plurality of cooling passages formed through the support plate for accommodating a flow of the cooling medium, a plurality of through holes formed through said support plate, said through holes being disposed and dimensioned for supporting the respective heat transmission tubes therein, each said through hole having a peripheral edge defining tongue-like pieces which are curved at a diameter slightly smaller than the outside diameter of the heat transmission tubes, said tongue-like pieces being deflected at intermediate locations thereon such that said support plate is made slidable on the outer periphery of each of the respective heat transmission tubes and is placed at a predetermined position on the outer periphery of each of said respective heat transmission tubes as a result of slidable insertion of said heat transmission tubes into the through holes, said support plate being secured by means of a frictional resistance between the tongue-like pieces and the outer periphery of the heat transmission tubes for elastically supporting said heat transmission tubes in response to vibrations of said apparatus.

14. The EGR gas cooling apparatus as defined in claim 13, wherein the tongue-like pieces and the heat transmission tubes are further affixed by brazing.

15. The EGR gas cooling apparatus as defined in claim 13, wherein the support plate is formed with notches between the respective tongue-like pieces, the notches being dimensioned to define a plurality of the cooling passages through said support plate.

16. The EGR gas cooling apparatus as defined in claim 13, wherein the heat transmission tubes are corrugated.

17. The EGR gas cooling apparatus as defined in claim 13, wherein the through holes for supporting the heat transmission tubes include extensions for permitting a flow of the cooling medium.

18. An EGR gas cooling apparatus, comprising a barrel having opposed open ends and an inner surface extending between said ends, said inner surface defining an inside diameter, tube sheets affixed to the inner surface of the barrel in proximity to the ends, each said tube sheet having a plurality of apertures therethrough, a plurality of heat transmission tubes fixedly arranged in the apertures of the tube sheets and extending therebetween, each said heat transmission tube having an outer periphery defining an outside diameter, end caps being mounted on both said ends of the barrel, an inlet and an outlet for EGR gas being provided through said respective end caps an inlet for a cooling medium and an outlet therefor extending into the barrel at locations between the respective tube sheets, said apparatus comprising:

a support plate having a plurality of cooling passages formed through the support plate for accommodating a flow of the cooling medium a plurality of through holes extending through the support plate for supporting the respective heat transmission pipes, each said through hole having a peripheral edge, the support plate being disposed inside the barrel and forming at a periphery thereof a plurality of first tongue-like pieces which are curved at a diameter slightly larger than the inside diameter of the barrel, said first tongue-like pieces being deflected at intermediate positions thereon sufficiently to provide slidableness on the inner surface of the barrel, and forming at the peripheral edge of the through holes thereof second tongue-like pieces which are curved at a diameter slightly smaller than that of the heat transmission tubes said second tongue-like pieces being deflected at intermediate positions thereon sufficiently to provide slidableness on the outer periphery of the heat transmission tubes, whereas as a result of slidable insertion of the support plate inside the barrel and another slidable insertion of the heat transmission tubes into the through holes, the support plate being disposed at a predetermined position on the outer periphery of said heat transmission tubes and being secured by means of frictional resistance between the first tongue-like pieces and the inner wall of the barrel and between the second tongue-like pieces and the outer periphery of the heat transmission tubes for exhibiting elasticity in response to vibrations.

19. The EGR gas cooling apparatus as defined in claim 18, wherein the first tongue-like pieces are further affixed by brazing to the inner wall of the barrel and the second tongue-like pieces are further fixed by brazing to the heat transmission tubes.

20. The EGR gas cooling apparatus as defined in claim 18, wherein the support plate is formed with notches between the respective tongue-like pieces for defining a plurality of said cooling passages.

21. The EGR gas cooling apparatus as defined in claim 18, wherein the heat transmission tubes are corrugated.

22. The EGR gas cooling apparatus as defined in claim 18, wherein the through holes supporting the heat transmission tubes include extensions that define the cooling passages for permitting a flow of cooling medium.

* * * * *